US005380579A

United States Patent [19]

Bianchi

[11] Patent Number: 5,380,579

[45] Date of Patent: Jan. 10, 1995

[54] HONEYCOMB PANEL WITH INTERLOCKING CORE STRIPS

[75] Inventor: Robert Bianchi, Cranford, N.J.

[73] Assignee: Accurate Tool Company, Inc., Union, N.J.

[21] Appl. No.: 144,193

[22] Filed: Oct. 26, 1993

[51] Int. Cl.[6] ..... B32B 3/28

[52] U.S. Cl. ..... 428/184; 428/116; 428/118; 428/120; 428/172; 428/178; 428/182; 428/223; 52/796; 52/800; 156/160; 156/167; 156/205; 156/241; 264/286

[58] Field of Search ..... 428/174, 182, 184, 119, 428/120, 116, 118, 178, 33, 52, 152, 99, 192, 172, 223; 52/796, 800; 156/65, 160, 167, 196, 205, 210, 241; 264/286, 505

[56] References Cited

U.S. PATENT DOCUMENTS

| | | | |
|---|---|---|---|
| 2,874,754 | 2/1959 | Yost et al. | 428/182 |
| 2,910,153 | 10/1959 | Campbell | 189/34 |
| 3,125,196 | 3/1964 | Feener | 189/82 |
| 3,144,881 | 8/1964 | Sproull | 138/117 |
| 3,200,489 | 8/1965 | Kelleric | 29/470.9 |
| 4,197,341 | 4/1980 | Rule | 428/118 |
| 4,618,152 | 10/1986 | Campbell | 277/53 |
| 4,643,933 | 2/1987 | Pickens | 428/116 |
| 4,832,999 | 5/1989 | Sweet | 428/116 |
| 5,116,688 | 5/1992 | Sugihashi et al. | 428/582 |

*Primary Examiner*—Donald J. Loney
*Attorney, Agent, or Firm*—Allen N. Friedman

[57] ABSTRACT

The core of a honeycomb panel consists of a set of corrugated strips each of which alternate abut the immediately adjacent strips. Interlocking protrusions are formed in the abutting portions of the strips. The protrusions provide automatic registration of the strips without jigging or fixturing. Preferably the protrusions are somewhat undercut to provide a detent or snapping action upon assembly to provide mechanical integrity prior to bonding. The snapping action also holds the abutting surface together for uniform bonding. Lateral registration of the strips can be provided by, for example, forming a lance and window or mating dimples in the abutting surfaces. Bonding of the abutting surfaces can be done by soldering, brazing, or gluing. This honeycomb core structure is suitable for the continuous fabrication of panels of arbitrary length, width, and thickness.

20 Claims, 3 Drawing Sheets

HONEYCOMB PANEL WITH INTERLOCKING CORE STRIPS

BACKGROUND OF THE INVENTION

1. Field of the Invention

The invention is in the field of the structure and fabrication of honeycomb panel as a rigid, light weight structural element.

2. Brief Description of the Background Art

Honeycomb panel is a structural element widely used for applications requiring the combination of rigidity and light weight. However, fabrication of honeycomb panel can be quite complex and expensive. The panel consists of side sheets bonded to a honeycomb core, consisting of many strips of sheet material. The strips are bonded to form an array of, typically, hexagonal shapes. One common method of bonding the strips to one another is spot welding. However, this is a complex repetitive operation that limits the thickness of panel that can be produced, particularly for smaller hexagonal cells.

Another limitation of many prior art processes is the jigging and fixturing needed to hold the strips in position and registration for bonding. Prior Art Techniques that have addressed some of these problems have introduced other limitations in, for example, the achievable size of the panel produced. For example, U.S. Pat. No. 2,910,153 shows a honeycomb panel whose core consists of a series of flanged strips, fitting together at the flanged edge of each strip. While providing automatic registration and being disclosed as interlocking, these strips must be held together prior to bonding and, for thicker panels, the strips can separate at the center, possibly degrading the panel's structural strength. U.S. Pat. No. 3,200,489 discloses a method that produces uniform bonding through the thickness of the panel, but does not produce automatic registration of the component sheets. Without accurate jigging and fixturing, this could result in nonuniformities in the core and weak points in the panel. The herein disclosed invention solves these problems and others in a way that removes many of the limitations inherent in prior art processes.

SUMMARY OF THE INVENTION

The herein disclosed invention is a honeycomb panel with a core that is adapted for ease of assembly, uniformity and strength. It is also amenable to continuous fabrication into panels of arbitrary length, width and thickness. The panel core consists of a set of corrugated strips each of which alternately abut the immediately adjacent strips. Interlocking protrusions are formed in the abutting portions of the strips. The protrusions provide automatic registration of the strips without jigging or fixturing. Preferably the protrusions are somewhat undercut to provide a detent or snapping action upon assembly to provide mechanical integrity prior to bonding. The snapping action also holds the abutting surface together for uniform bonding. Lateral registration of the strips can be provided by, for example, forming a lance and window or mating dimples in the abutting surfaces. Bonding of the abutting surfaces can be done by soldering, brazing, or gluing. Since the strips can be made to snap together, this core structure can be continuously fabricated by, for example, starting with a set of rolls of the strip, feeding the strips into a set of tools and dies to form the corrugations and protrusions, assembling the core, applying the face sheets from rolls of sheet materials, and feeding the assembly into an oven for, for example, brazing, setting an adhesive or fusing a thermoplastic polymer layer.

In addition to holding the core together prior to bonding, the protrusions, running through the entire thickness of the core provide several other advantages. The multiple folds provide additional stiffness to each strip and the additional contact area between the strips provides additional bond strength. This additional bonding area may even permit use of an adhesive for an application that would otherwise call for brazing to provide the required panel strength. In addition, the positive contact force produced by the undercutting and snapping action holds the strips together uniformly along their entire width to suppress or entirely prevent the formation of voids or skips during bonding. Exemplary embodiments of the disclosed invention are illustrated in the appended figures.

DETAILED DESCRIPTION OF THE INVENTION

Figure 1:
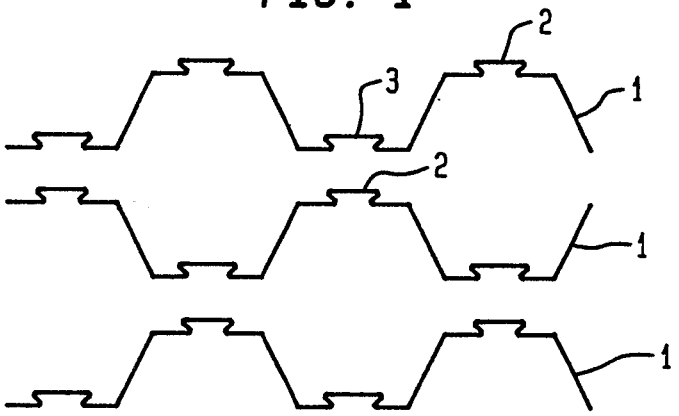
FIG. 1 is a plan view of a set of corrugated strips, prior to assembly to form a core.

A honeycomb panel consist of a core bounded by facing sheets. The core is composed of thin strips bent and bonded together to form a, typically, hexagonal cell structure. The core is bonded between facing sheets to form the rigidity and light weight that is characteristic of the honeycomb panel structure. The rigidity of the structure is supplied by the compressive strength of the strip material which is prevented from buckling under edge compression by the multiple bends. These multiple bends permit quite thin material to be used to produce a panel structure which is surprisingly resistent to compressive stress. When honeycomb panel material does fail in compression, a great deal of energy is absorbed in the folding and bending of the honeycomb strip material. This property is used to produce panels that are specifically designed to absorb energy upon impact, for example during automobile crashes.

In the honeycomb panel of the invention protrusions are formed in the core strips by producing additional bends and folds of the strip material. These protrusions are formed so as to engage one and other during assembly of the core and hold together without jigging the fixturing preferably these protrusions are undercut or reflexively bent to produce a detent or snapping action during assembly, producing a positive force holding the strips together.

Another advantage of the inventive structure is the additional stiffness supplied by the multiple bends and folds used to produce the protrusions in the core strips.

This provides additional compressive strength per unit of strip thickness. For some uses the detent action alone may provide enough mechanical integrity in the core that, when bonded to the face sheets, the composite structure will have sufficient rigidity. However, in most cases the strips are bonded together by such methods as soldering, brazing or gluing. Bonding materials such as brazing powders in a binder, lower melting point solders, thermoplastic resins, or contact adhesives may be coated on to the strip material prior to the bending operations. This material may even be printed on to the strips in predefined areas so that only the area of the strip which will contact the adjacent strip is coated. For bonded cores the protrusions of the invention provide an additional advantage. They provide additional contact area for bonding, increasing the bond strength between the strips. This may permit the use of weaker but more convenient bonding materials for a particular application. The inventive structure also provides automatic registration of the strip contact areas providing more accurate assembly. In reflexively bent structures the positive holding force between the strips also improves the uniformity of bonding, preventing voids and skips in the adhesion of the bonding material between the strips.

The fact that the strips hold together prior to bonding permits the continuous fabrication of panels of arbitrary length, width and thickness. The core strips and the panel face material can be fed from rolls of core and face material into a continuous processing apparatus. The length of the panel produced is thus limited only by the length of the rolls of core and facing material. The panel thickness is limited only by the width of the strip material and the panel width is limited only by the number of strips used and the width of the facing material. The core strips can be fed into a series of tools and dies used to bend and fold them to the desired multiply folded shape. The strips can then be assembled by snapping them together. The facing sheets can be applied on either side from rolls of sheet material. The assembly can then be passed into an oven if elevated temperature is required for the particular bonding process used.

The interlocking nature of the core strips of the invention and the fact that they can hold together without jigging and fixturing also permits the fabrication of individuals units or small runners, for which it is not economical construct the jigs and fixtures which otherwise would be required. The individual strips can be cut to length and snapped together to form the desired units, for example, if units of irregular outline are desired. FIG. 1 shows a series of core strips that have been bent and folded by tools and dies across their entire width to form a generally corrugated shape, succeeding upward bends and downward bends each forming a corrugation. Protrusions 2, 3 have been formed in the material. They are shaped so as to engage one another when the strips 1 are brought together to abut. The protrusions 2, 3 can be arranged to simply engage one another, or, preferably, as illustrated in FIG. 1, be undercut or reflexively bent to produce a detent action so that the strips 1 will snap together when assembled. The strips illustrated are shown with protrusions of a dove tailed cross section. However, other shapes can also be used such as the many interlocking shapes one sees in a typical jigsaw puzzle. While as few as two strips can be used to illustrate the invention and utilize its advantage, the use of five strips with at least five corrugations in each strip is preferable to provide sufficient mechanical rigidity to take best advantage of the invention.

Figure 2:
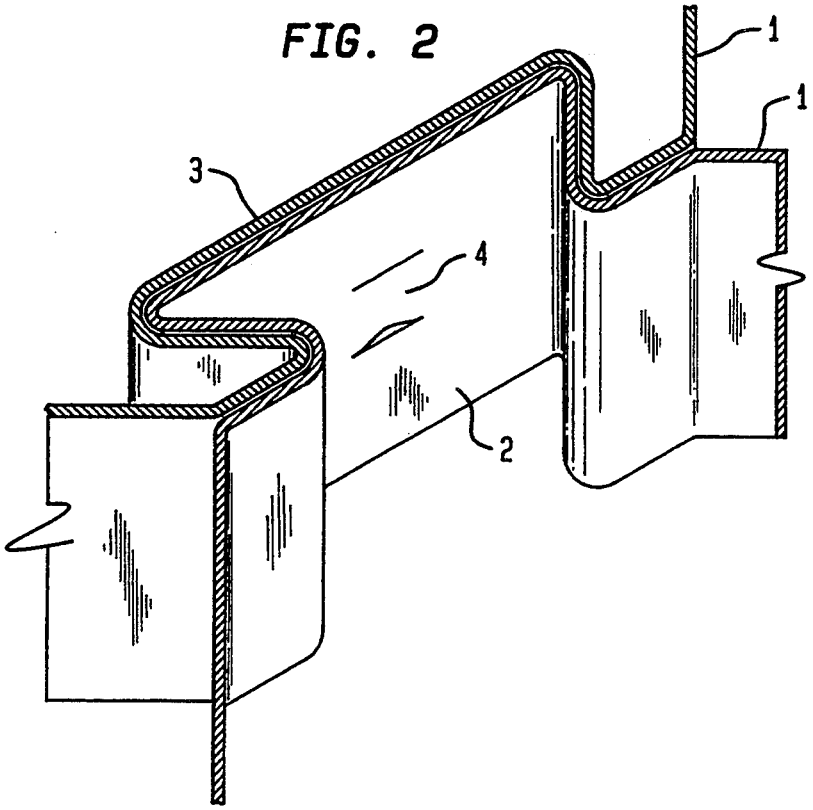
FIG. 2 is a perspective view of portions of two contacting corrugated strips showing contacting members engaged with a dovetail profile.
Figure 3:
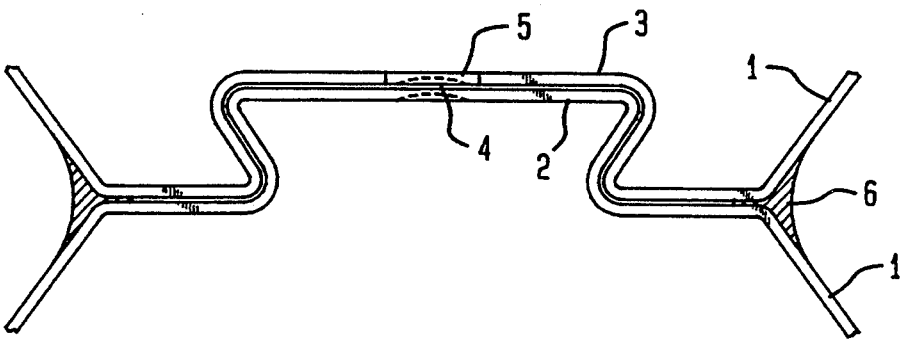
FIG. 3 is a cross sectional view of the corrugated strips depicted in FIG. 2, showing a lance and window providing lateral registration.

FIG. 2 shows a portion of two strips 1 in abutment. It shows the corresponding protrusions 2, 3 engaged in a positively interlocking condition. In addition it shows a lance 4 formed in protrusion 2. FIG. 3 showing a cross section view of the same strips 1, shows how the lance 4, protrudes in a window 5, formed in the protrusion 3. The engagement of the lance 4 and window 5 inhibits lateral slippage of the two strips 1 providing lateral registration of the strips 1. FIG. 3 also shows bonding material 6 between the strips 1. The figure shows only the fillet of bonding material 6, where the strips 1 separate. However the bonding material typically fills the area between the strips 1 in a very thin layer.

Figure 4:
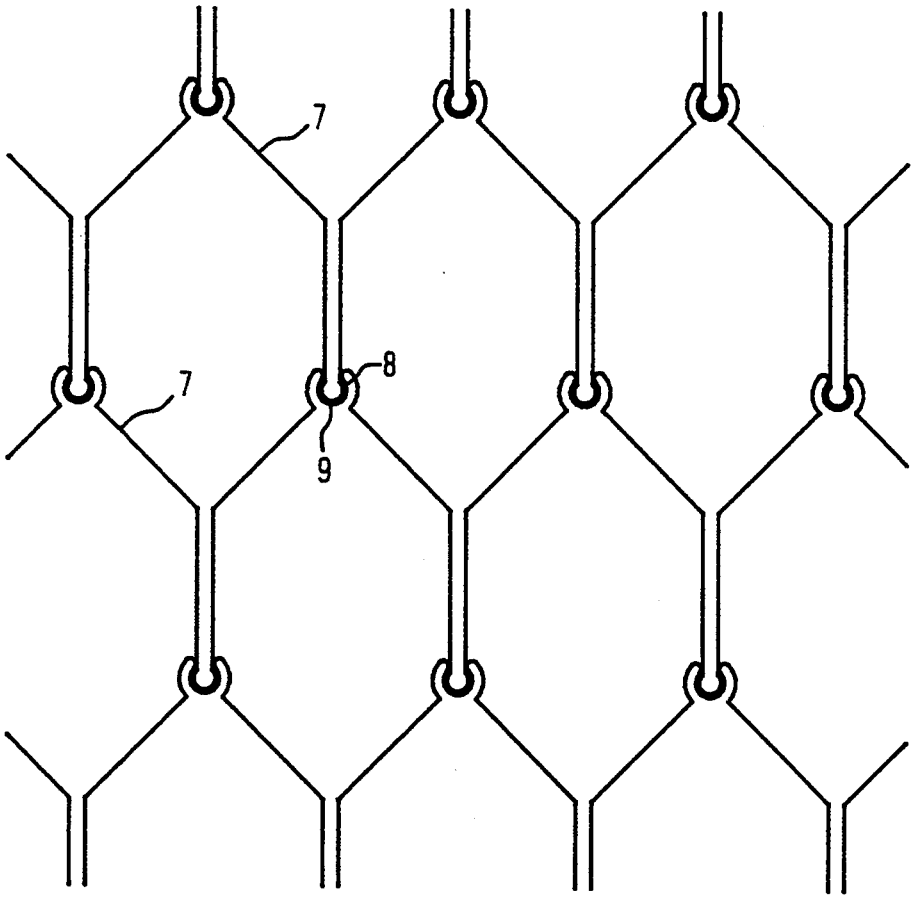
FIG. 4 is a cross sectional view of an assembled core with hexagonal cells in which the corrugated strips engage one another at a cell apex.
Figure 5:
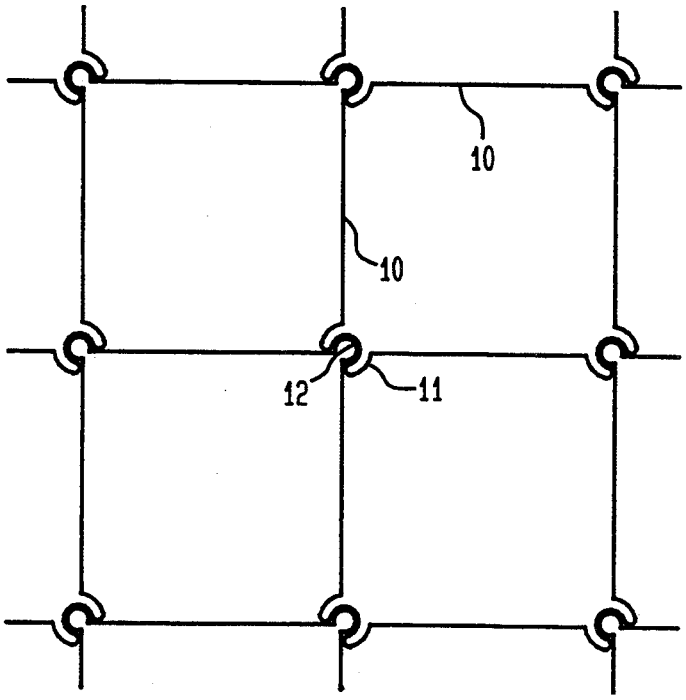
FIG. 5 is a cross sectional view of a assembled core with rectangular cells.

FIG. 3 illustrate a lance and window arrangement to provide lateral registration of the strips. However there are other possible arrangements such as the dimpling of both strips 1, or a dimple in one of the strips 1, engaging a round hole in the abutting strip. While the strip geometry illustrated in FIGS. 1, 2 and 3 in which the strips abut along a face of a generally hexagonal core structure is preferred for its economy and rigidity many other geometries are possible. FIGS. 4 and 5 illustrate two other possible geometries. In FIG. 4 the strips 7 are bent and folded such that protrusions 8, 9 engage one and other at an apex of the approximately hexagonal cells. In FIG. 5 the strips 10 are formed such that the protrusions 11, 12 engage one and other at the corners of approximately rectangular cells.

Figure 6:
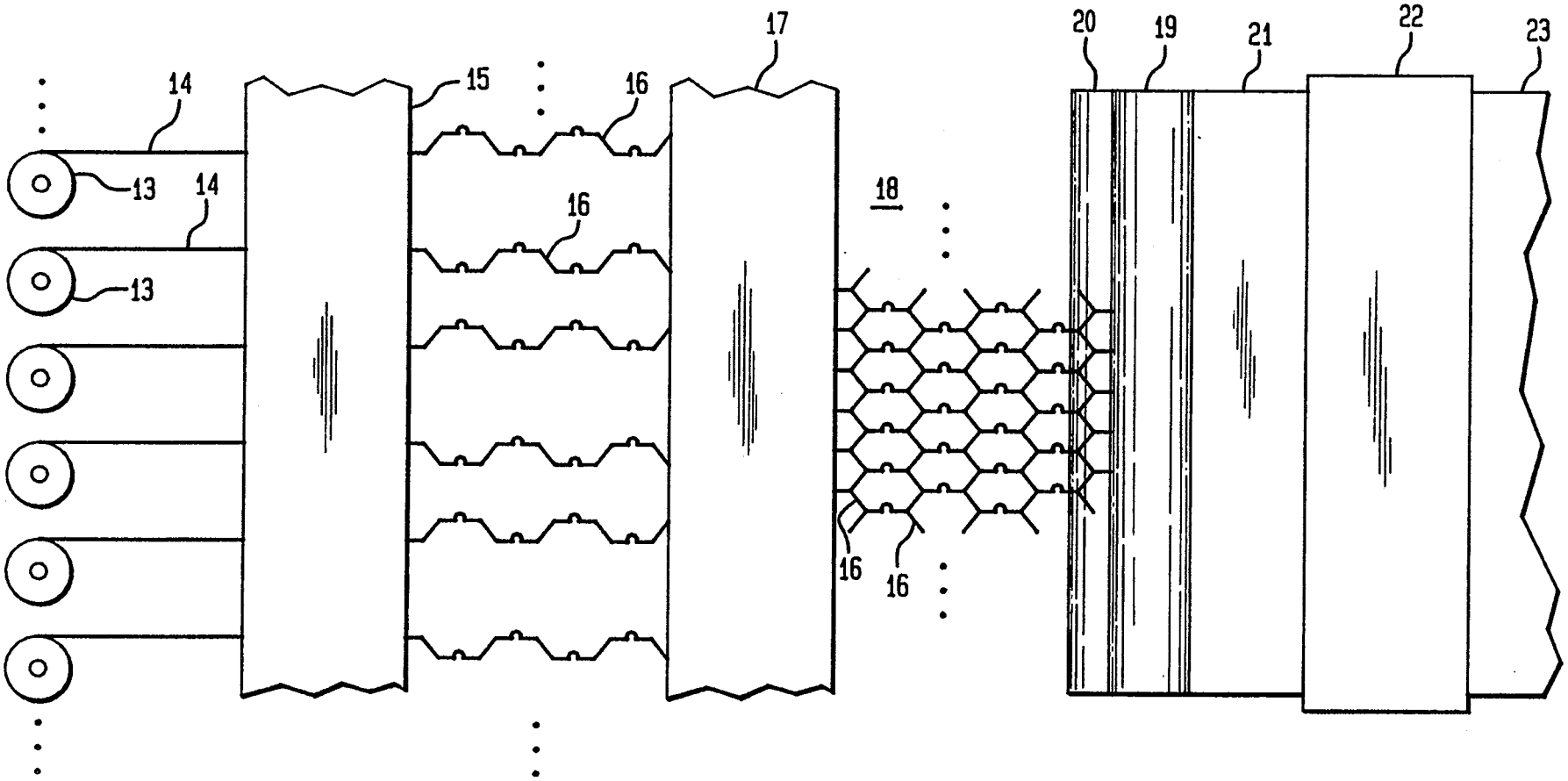
FIG. 6 is a partially schematic plan view of a continuous honeycomb panel production apparatus.

FIG. 6 shows an apparatus for the continuous production of honeycomb core panel. In this apparatus rolls 13 of core strip 14 feed the strip 14 into a corrugator 15 within which tools and dies bend and fold the strip material 14. The corrugated strips 16 are then fed into an assembler 17, to produce the honeycomb core 18. The honeycomb core 18 is fed between two rolls 19, 20 of facing sheet material 21. If heat is required to bond the core strips together and to bond the core to the face material 21, the assembly is fed into an oven 22 to raise the assembly to a predetermined temperature and the final honeycomb core panel 23 is produced. The panel can be as long as the strips of core material 14 and face material 21 or can be cut to the desired length.

What is claimed is:

1. A core for a structural element comprising a plurality of corrugated strips of a first sheet material, each strip alternately contacting adjacent strips, each strip having a plurality of first protrusions and a plurality of second protrusions, said first and second protrusions so disposed that the first protrusions of each strip engage the second protrusions of the adjacent strips along the entire width of each strip and in which the first protrusions engage the second protrusions with a detent action, the core being a mechanically integral unit, the strips being held together by a positive contacting force.

2. A core of claim 1 in which the first protrusions and the second protrusions consist essentially of multiple folds of the first sheet material.

3. A core of claim 1 in which the first and second protrusions have a dove-tail profile.

4. A core of claim 1 including at least five corrugated strips.

5. A core of claim 1 in which a plurality of the first protrusions includes at least one lance and a plurality of the second protrusions includes at least one window so disposed that each lance engages a window when the first protrusions engage the second protrusions, whereby lateral slippage of the contacting corrugated strips is inhibited.

6. A core of claim 1 in which the contacting corrugated strips generally define an array of hexagons.

7. A core of claim 6 in which each of the first and second protrusions is situated on a face of one of the hexagons.

8. A core of claim 6 in which each of the first and second protrusions is situated at an apex of the hexagons.

9. A core of claim 1 in which each of the corrugated strips is bonded to adjacent strips.

10. A core of claim 9 in which the corrugated strips are bonded to adjacent strips by means of an adhesive material.

11. A core of claim 10 in which the adhesive material is a thermoplastic polymer.

12. A core of claim 1 in which the first sheet material and the adhesive material are metallic.

13. A core of claim 1 in which the first sheet material is a polymer impregnated paper.

14. A structural element comprising a plurality of corrugated strips of a first sheet material, each strip alternately contacting adjacent strips, each strip having a plurality of first protrusions and a plurality of second protrusions, said first and second protrusions being reflexively formed to produce a detent action upon assembly, said first and second protrusion so disposed that the first protrusions of each strip engage the second protrusions of the adjacent strips along the entire width of each strip as a core; and a first facing sheet and a second facing sheet of a second sheet material disposed on either side of the core and bonded thereto.

15. A method for fabricating a core for a structural element comprising the steps of:

corrugating a plurality of strips of a sheet material and forming in the entire length or each corrugation a first protrusion and a second protrusion said first and second protrusions being reflexively formed to produce a detent action upon assembly; and assembling the core by engaging the first protrusions of each strip with the second protrusions of adjacent strips whereby the core is a mechanically integral unit, the strips being held together by a positive contacting force.

16. A method of claim 15 further including the step of bonding each of the corrugated strips to adjacent strips.

17. A method of claim 16 wherein the bonding step includes raising the temperature of the corrugated strips to a predetermined bonding temperature.

18. A method of claim 15 further including the step of coating at least one side of the sheet material with a bonding material.

19. A method of claim 18 in which the coating step precedes the corrugating step.

20. A method of claim 18 in which the coating step includes printing the bonding material onto predefined areas of the sheet material.

* * * * *